US006006795A

United States Patent [19]

Corain et al.

[11] Patent Number: 6,006,795

[45] Date of Patent: Dec. 28, 1999

[54] LINEAR MOTOR SELECTOR DEVICE FOR WEFT YARN PRESENTATION IN SHUTTLELESS LOOMS

[76] Inventors: Luciano Corain, V.E. Rooaana-1-0360As; Luigi Corazzola; Giulio Bortoli, both of V.E. Rooaana-N°A-360As, all of Schio (V.), Italy

[21] Appl. No.: 09/075,168

[22] Filed: May 11, 1998

[30] Foreign Application Priority Data

Jul. 30, 1997 [IT] Italy ..... MI97A1822

[51] Int. Cl.[6] ..... D03D 47/38

[52] U.S. Cl. ..... 139/453; 139/438; 66/138

[58] Field of Search ..... 139/453, 438; 66/127, 133, 138, 125 R

[56] References Cited

U.S. PATENT DOCUMENTS

| | | | |
|---|---|---|---|
| 4,936,355 | 6/1990 | Jankovsky | 139/453 |
| 4,998,420 | 3/1991 | Scavino | 139/453 |
| 5,090,457 | 2/1992 | Corain et al. | 139/453 |

FOREIGN PATENT DOCUMENTS

| | | |
|---|---|---|
| 0 293 558 | 12/1988 | European Pat. Off. . |
| 0 461 524 | 12/1991 | European Pat. Off. . |
| 0 676 493 | 10/1995 | European Pat. Off. . |
| 1 801 016 | 10/1969 | Germany . |
| 09268453 | 10/1997 | Japan . |
| 630 124 | 5/1982 | Switzerland . |

*Primary Examiner*—Andy Falik
*Attorney, Agent, or Firm*—Nixon & Vanderhye

[57] ABSTRACT

A device for weft yarn presentation in a shuttleless loom is operated by linear electric motors. The motors include fixed plates and movable plates pivotally mounted to the fixed plates. Yarn presenting rods are carried by the pivotal plates and rotate from raised stand-by positions to lowered delivery positions. The respective axes of rotation of the pivoted plates are arranged on a line skewed to the path of movement of the gripper so that the weft yarn delivery positions are close together.

7 Claims, 7 Drawing Sheets

LINEAR MOTOR SELECTOR DEVICE FOR WEFT YARN PRESENTATION IN SHUTTLELESS LOOMS

BACKGROUND OF THE INVENTION

This invention relates to a selector device for weft yarn presentation in shuttleless looms.

More specifically, the invention relates to a device for presenting the weft yarns to the grippers of shuttleless looms in which the various yarns carried into operation are presented within a narrow space interval to the gripper which inserts them into the shed.

To better illustrate the technical problem faced by this invention, together with the particular difficulties and requirements of shuttleless looms, reference is made hereinafter to the method of weft yarn presentation in such looms which is illustrated schematically in 1A,1B,2A and 2B.

FIG. 1A shows to the right the already produced fabric 1 and the shed open in the two planes 2 and 3 by the movement of the heddles, not shown in the figures for simplicity. Each time the shed opens, and with suitable synchronism, one or more weft yarns are inserted into it depending on the fabric pattern to be produced, this yarn or these yarns being delivered to a gripper 4 which is propelled and guided into the shed by a semirigid tape 5 which winds and unwinds with reciprocating rectilinear movement in the direction of the double arrow 6 by the effect of the reciprocating rotary movement, in the direction of the arrow 7, of lateral operating wheels 8 which are precision-controlled in terms of times, excursion and velocity. In the most widely used looms the weft yarn insertion gripper consists in reality of a pair of grippers which move starting from the two sides of the fabric, to meet in the middle where that gripper which has taken the yarn from the presentation device, and has completed its travel along one half of the width of the fabric, transfers it to the gripper on the other side, which turns back to complete its travel along the other half of the fabric width. The weft yarn inserted in this manner into the shed is incorporated into the fabric by the beating of the reeds, not shown in the figures for simplicity. During its reciprocating rectilinear movement the gripper 4 moves along the dashed-line horizontal trajectory 9.

The plurality of weft yarns which are to be inserted and woven with the warp yarns to form the fabric are contained on bobbins 10. FIG. 1A shows only four bobbins 19*a, b, c, d* for simplicity of drawing, however they are present in a greater number, generally eight but in certain cases more.

The weft yarn is presented to the gripper 4 by presentation rods 11*a, b, c, d*—again only four are shown for simplicity—which receive their weft yarn 12*a, b, c, d* from the respective bobbin 10*a, b, c, d*, after passage through the respective yarn feelers 13*a, b, c, d*. The presentation rods 11 are each provided with an end eyelet through which the respective weft yarn 12 passes. These rods can move between two positions, namely an upper rest position and a lower position in which they deliver the respective weft yarn to the gripper 4. In FIG. 1A the rods 11*a, c, d* are in their upper position and maintain the respective yarn out of range of the gripper, whereas the rod 11*b* is in its lower position in which it delivers the yarn 12*b* to the gripper 4 which is still retracted towards its propelling wheel 8 but is about to arrive at the position in which it grips the weft yarn.

The rods 11, for example the rod lib in FIG. 1B, move into their lowered delivery position to rest their yarn on a stop bar 14, so that the various weft yarns presented one by one to the gripper 4 lie in the generally horizontal plane defined by the upper edge of the bar 14 and the vertex 15 of the shed, in which region all the weft yarns of the fabric under production converge. By suitably adjusting the level of the bar 14, this plane can be made to contain the trajectory line 9 of the gripper 4, so that the gripper necessarily encounters the yarn presented to it at the appropriate time by one of the rods 11.

FIG. 1B schematically shows the situation after the yarn has been gripped by the gripper which has advanced along the line 9 towards the open shed. Downstream of the position in which the yarn is presented there is a cutting member 16, here indicated conventionally as scissors, which intercepts that portion of weft yarn lying between the moving gripper 4 and the vertex 15, to cut it with appropriate synchronism so that the weft yarn carried into the open shed is that which unwinds from its bobbin, and does not involve yarn on the same side as the already produced fabric. In FIG. 1A the scissors are shown open whereas in FIG. 1B they are shown closed with the yarn 12 cut. To better illustrate the requirements of gripper looms and the characteristics and advantages of this invention, reference will now be made to FIGS. 2A and 2B, which show respectively in transverse view and plan view the configuration shown in perspective view in FIGS. 1A and 1B, respectively.

FIG. 2A shows the rods 11*a, c, d* maintaining the respective weft yarns 12*a, c, d* raised, whereas the rod 11*b* is lowered with its yarn 12*b* resting on the bar 14. This yarn joins the edge of the bar 14 to the vertex 15. This configuration is shown in plan view in FIG. 2B, which shows the various lowered positions A, B, C, D in which the various rods 11 deliver their yarn to the gripper when they are lowered by the action of the presentation unit 17, consisting of a plurality of actuators 17*a, b, c, d* which lower and raise their rod 11*a, b, c, d* when it is the turn of their yarn, again considering that in effect the number of yarns, bobbins, yarn feelers and rods is greater, and normally eight or more.

As shown in FIGS. 1A, 1B, 2A and 2B, the rods 11 project with progressively increasing length and height from 11*a* to 11*d*, to maintain the various weft yarns at a greater distance apart when in their stand-by position. In this respect, each yarn to be presented must be lowered with reliability by operating its rod, without also presenting one of the yarns of the adjacent rods by the effect of the hairiness of or electrostatic charges on the yarns. As a result of this arrangement the points A, B, C, D representative of the plurality of weft yarn presentation members are shown as a segment inclined to the working line 9 of the gripper 4.

The delivery of the weft yarn is progressively more difficult from the first yarn 12*a* to the last yarn 12*d*, this number being shown for ease of drawing, however in fact they are of a greater number. As can be clearly seen from FIG. 2B, the yarn 12*a* is encountered by the gripper at the point A' and lies at a very acute angle to the trajectory 9, whereas the last yarn 12*d* is encountered by the gripper at the point D' and lies at a considerably less acute angle to the trajectory 9.

In this respect it must be noted that such a gripper 4 is currently constructed with the precise requirement of gripping only those yarns which it encounters at a narrow angle, whereas it does not grip any yarns which it encounters at a right angle or an angle which is not narrow. This requirement corresponds to the requirement that, should the shed not be perfectly open and any warp yarn is not completely raised or lowered, the gripper 4 must not grip it and pull it, but only shift it from its path, to raise it or lower it into the required position. Under such conditions those yarns more to the left in FIG. 2B have a greater probability of being gripped correctly, whereas the yarns more to the right have a greater uncertainty of correct outcome of the operation.

A further uncertainty in the proper gripping of those weft yarns more to the right on the drawing by the gripper is due to the fact that during gripping, the gripper is under considerable acceleration. It must be noted that in looms of the type under consideration, the frequency of the weaving cycle is currently of the order of 600–700 beats per minute and hence the gripper must travel from rest, arrive at the middle of the width of the fabric, halt with precision to deliver the yarn to the opposite gripper and then withdraw without yarn, all within a total time of less than one tenth of a second. Under such circumstances those yarns more to the right are intercepted by the gripper at a much higher speed than the yarns more to the left, they hence being more stressed and thus gripped with less precision.

The technical problem of improving the operation of presenting the weft yarn and the device which performs this weaving stage in gripper looms is hence essentially to shift the segment A'–D' towards the left and to shorten the length s. In FIG. 2B this represents that length of the gripper path along which the various weft yarns are presented. There is also the requirement to reduce as much as possible the width of the angle a which in FIG. 2B comprises the bunch of straight lines joining the point 15 to the points A–D, these representing the lowering of the weft yarn by the rods 11*a–d* for delivery, while however satisfying the requirement that when in the raised stand-by position the ends of the rods 11 must be properly separated so as not to also involve undesired adjacent yarns during lowering.

BRIEF SUMMARY OF THE INVENTION

In a preferred embodiment, the weft yarn presentation apparatus includes, for a shuttleless loom for forming a fabric, a plurality of presentation devices, one for each weft yarn. Each presentation device includes a linear electric motor comprised of a fixed plate carrying permanent magnets, a rotary slider, and a rod rigidly connected to the slider and rotatable with the slider to present a weft yarn carried by an end thereof to a movable gripper. The sliders are pivotally mounted to the fixed plates, respectively, for rotation about respective axes. The rod ends are maintained separated from one another in raised positions thereof to maintain the weft yarns carried thereby separated from one another. The rod ends are also movable into lowered delivery positions for presenting the weft yarns to the gripper. The lowered positions of the rod ends are spaced closer to one another than the raised positions. The presentation devices are joined together to form an assembly thereof with the axis of rotation of each slider of each presentation device being offset from one another and arranged on a line skewed relative to a path of movement of the gripper. The fixed plates, in the direction of the fabric, are successively arranged in progressively raised positions and successive axes of rotation of the sliders are successively arranged in the direction of the plane of the respectively fixed plates with an offset angle between 0–90° relative to the horizontal.

BRIEF DESCRIPTION OF THE DRAWING FIGURES

FIG. 3C is a plan view illustrating the slider of FIG. 3A superposed on the plate of FIG. 3A;

DETAILED DESCRIPTION OF THE INVENTION

The weft presentation device of this invention uses linear electric motors for operating the presentation levers 11. The structure of these motors is shown schematically in FIGS. 3A and B. They are well known in the art and are widely applied in various industrial and textile fields, they being described for example in Italian Patent 1,217,872 or the corresponding European Patent Application 347,626 in the name of Scavino, and in Italian Patent 1,248,715 in the name of Vamatex or the corresponding European Patent Application 461,524. In this latter European Patent Application the weft presentation device operates by means of presentation rods which move translationally by converting the reciprocating rotation of the linear electric motor into reciprocating rectilinear movement using interposed flexible cables sliding within guide sheaths.

Figure 3A:
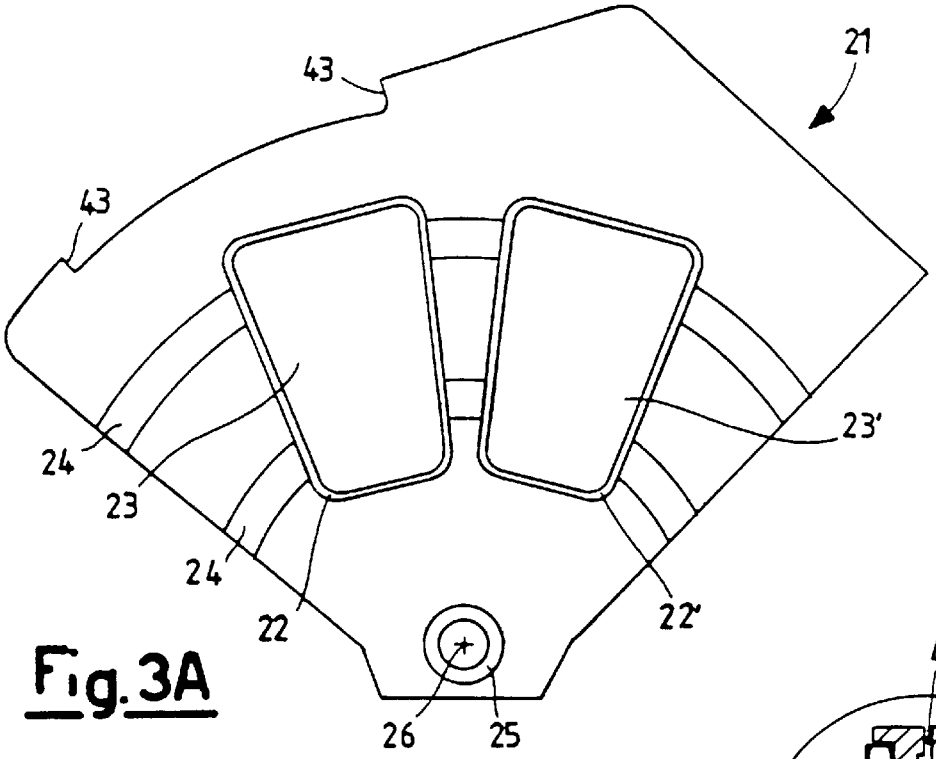
FIG. 3A is a plan view of a fixed frame forming a portion of a linear motor employed in the present invention.
Figure 3B:
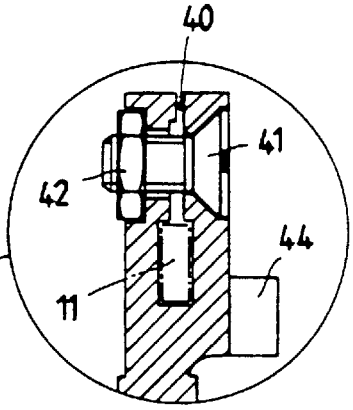
FIG. 3B is a plan view of a slider used in conjunction with the plate of FIG. 3A.
Figure 3B:
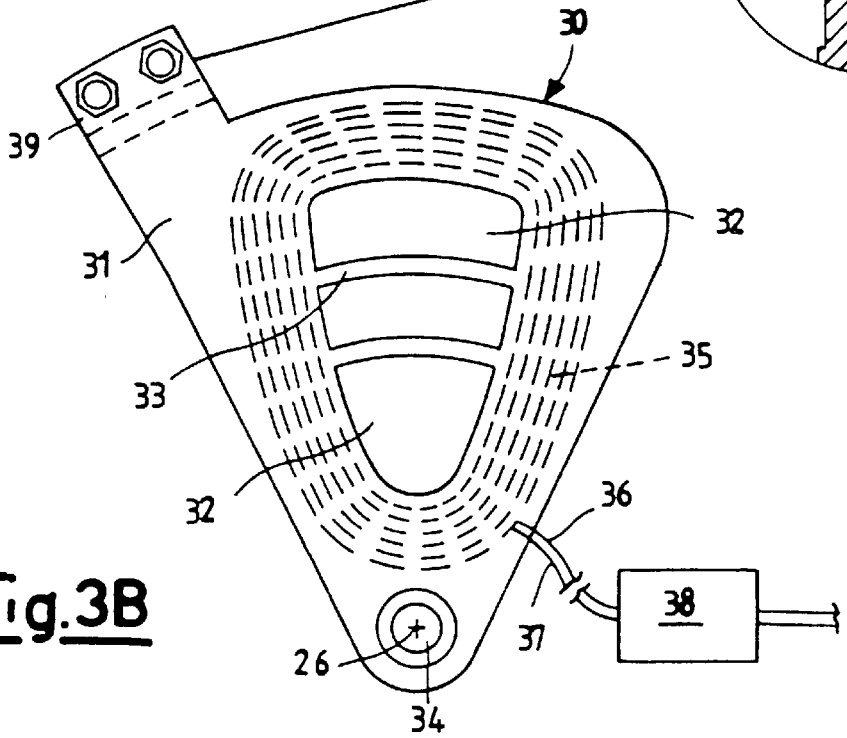

The linear motor used consists of a fixed frame 21 in the form of a plate of non-magnetic material, comprising two housings 22 and 22' into which two plate permanent magnets 23 and 23' respectively are inserted, as shown in FIG. 3A. These permanent magnets are located and fixed in their housing in such a manner as to present on that surface facing the moving element, which can for example be the surface of the drawing, a polarity which in one case is positive and in the other case negative. On the fixed frame plate 21 there are provided projections 24 acting as spacers for its slider or moving element, and a hole 25 for applying the connection to the moving element 30 for rotation about the center 26.

As shown in FIG. 38, the moving element 30 consists of a flat body 31 of material which is not electrically conducting, for example a polymer of good mechanical characteristics, with lightening holes 32 and stiffening ribs 33 which also act as spacers similar to the projections 24 on the fixed frame. The moving element or slider is also provided with a hole 34 for applying the connection to the frame 21, for example a pin and ball bearing of known type, and for rotation about the center 26. Within the flat body of the slider 30 there is incorporated a closed flat winding 35 connected by wires 36, 37 to a switch/modulator 38 for a d.c. electric power supply which energizes the winding 35 with current of reversible direction, to hence generate controllable magnetic forces of opposite polarity on the slider faces. At a vertex of the slider distant from the pin which connects it to its frame there is a projecting element 39 provided with a system for its adjustable fixing to the weft yarn presentation rod 11, for example by inserting the rod into a slot 40 provided in the projection and pressure-locking the rod 11 between its two parts with bolts 41 and nuts 42. The slider is driven by energizing its winding, its amplitude being controllable electronically.

The operation of a linear motor consisting of a fixed plate coupled to its slider is very simple and amply described in the known art, for example in the cited Italian Patent 1,217,872. Position changes are determined by feeding direct current to the winding 35 to hence induce a magnetic force which attracts the slider towards one of the magnets 23, 23' and repels it from the other, depending on the direction of the current fed to the winding. To maintain its position it is merely necessary to circulate a weak current always in the same direction. FIG. 3C shows the linear motor assembled. The rod 11 is clamped within the slot 40 so that the rod projects from the element 39 to a greater or lesser extent depending on its position in the sequence in which the rod is mounted in the presentation device of the invention, which is formed by combining a plurality of linear presentation motors as illustrated in FIGS. 3A, B, C. The method of assembling these components to form the presentation device is one of the salient characteristics of the invention, this consisting of mounting the various linear motors of the device offset one from another, so that the respective sliders rotate about a center 26*a, b, c, d*, which is offset one from another for the translational movement of the various linear motors.

Figure 4A:
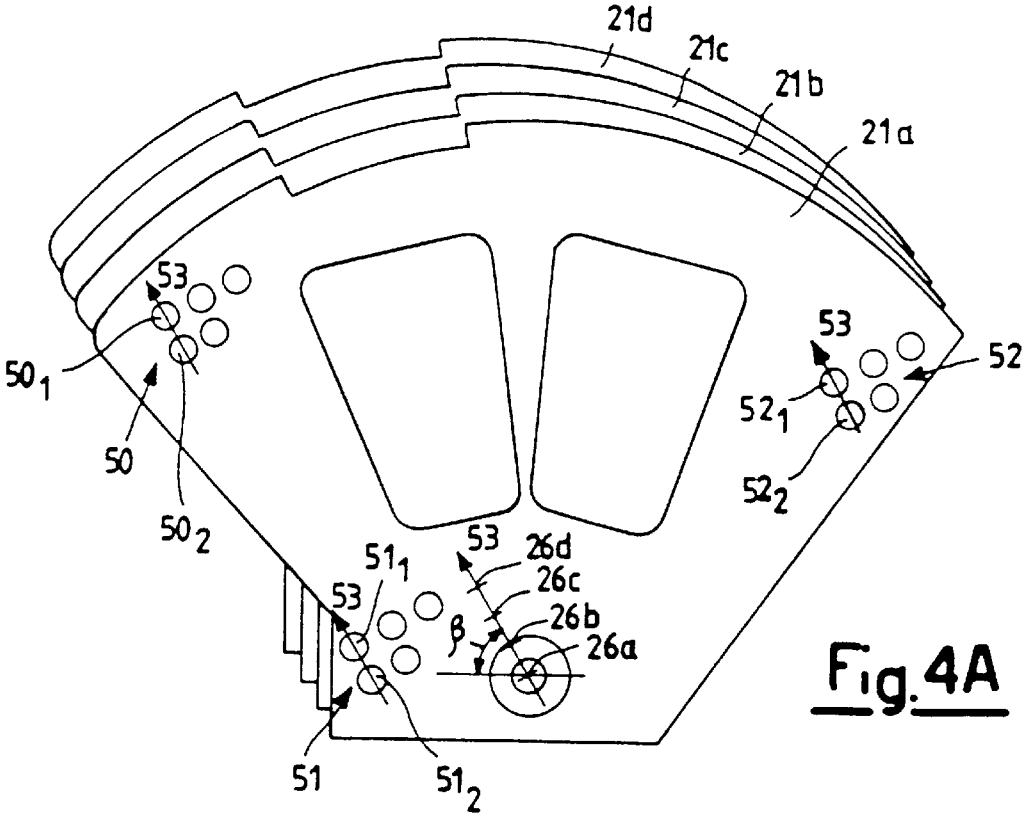
FIG. 4A illustrates a diverging arrangement of the fixed plates in the linear motor assembly.
Figure 4B:
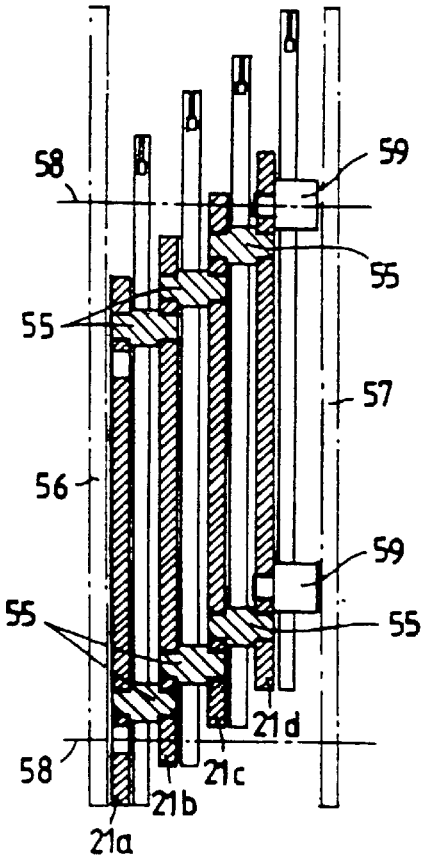
FIG. 4B is a cross-sectional view of the assembly of linear motors illustrating the parallel arrangement of the fixed plates thereof.

As shown in FIG. 4A, in which the frame plates 21*a, b, c* . . . are shown in front view without their moving slider 30*a, b, c* . . . , two or more sets of through holes 50, 51, 52 are provided, consisting of a plurality of holes of the same size forming a grid enabling the various plates 21 to be assembled by offsetting them in different predetermined directions by using two holes at a time as hereinafter described by way of example. This grid allows offset positioning of the plates during their assembly which, according to the invention, is achieved by arranging the direction of offset of the centers 26 at an angle β of 0°–90° in the direction of the plate. When the device has been mounted, this offset corresponds to inclinations of the same angle to the horizontal plane when in their operating position within the presentation device.

Generally, the plates progressively closer to the fabric must be progressively raised and made to approach the bar 14, to also satisfy the requirement of maintaining the weft yarns sufficiently spaced apart when at rest.

The plurality of grid holes provides the facility for offsetting the plates in a plurality of directions according to weaving requirements, by using a different pair of grid holes at any given time.

For example to offset the plate 21*a* from the plate 21*b* by one pitch in the direction 53, which corresponds to the approximately 65° direction of the index holes 1 and 2, the three holes $\mathbf{50}_1$, $\mathbf{51}_1$, $\mathbf{52}_1$ of the plate 21*a* are superposed on the holes $\mathbf{50}_2$, $\mathbf{51}_2$, $\mathbf{52}_2$ of the plate 21*b*, in the three lines of holes there being inserted spacer pins 55 consisting of two cylindrical end parts which penetrate as an exact fit into the holes 50, 51, 52 and have an intermediate enlarged part which acts as a spacer between the various frame plates which are hence mounted parallel but offset by one pitch in the direction 53. The intermediate spacer parts of the pins 55 are hence of equal length, at least for each of the pairs of mutually facing plates. FIG. 48 shows a view from the left side of the stack of plates 21, again shown as four in number for simplicity of drawing, but noting that they can be of a greater number.

The plates 21*a–d* stacked in this manner are locked by known means, for example by two flat end plates 56, 57 provided with holes and pressed together by a nut and bolt connection 58, which also asses through holes in the plates 21 in the outer positions. Both the connection 58 and the positioning pins 55 are located in a peripheral position so as not to interfere with the travel of the sliders 30 which present the respective rods 11. The last of the stacked plates is provided with spacer pins 59 so as not to hinder the rotary movement of its slider 30*d*.

The various centers of rotation 26*a, b, c, d* of the linear motors formed by each plate 21 and the relative slider 30 pivoted on it are hence offset by their own thickness and are positioned in the assembly direction 53, and lie on a line which is skewed to the gripper trajectory i.e., a line non-parallel to the linear. trajectory 9 of the gripper 4.

Figure 5:
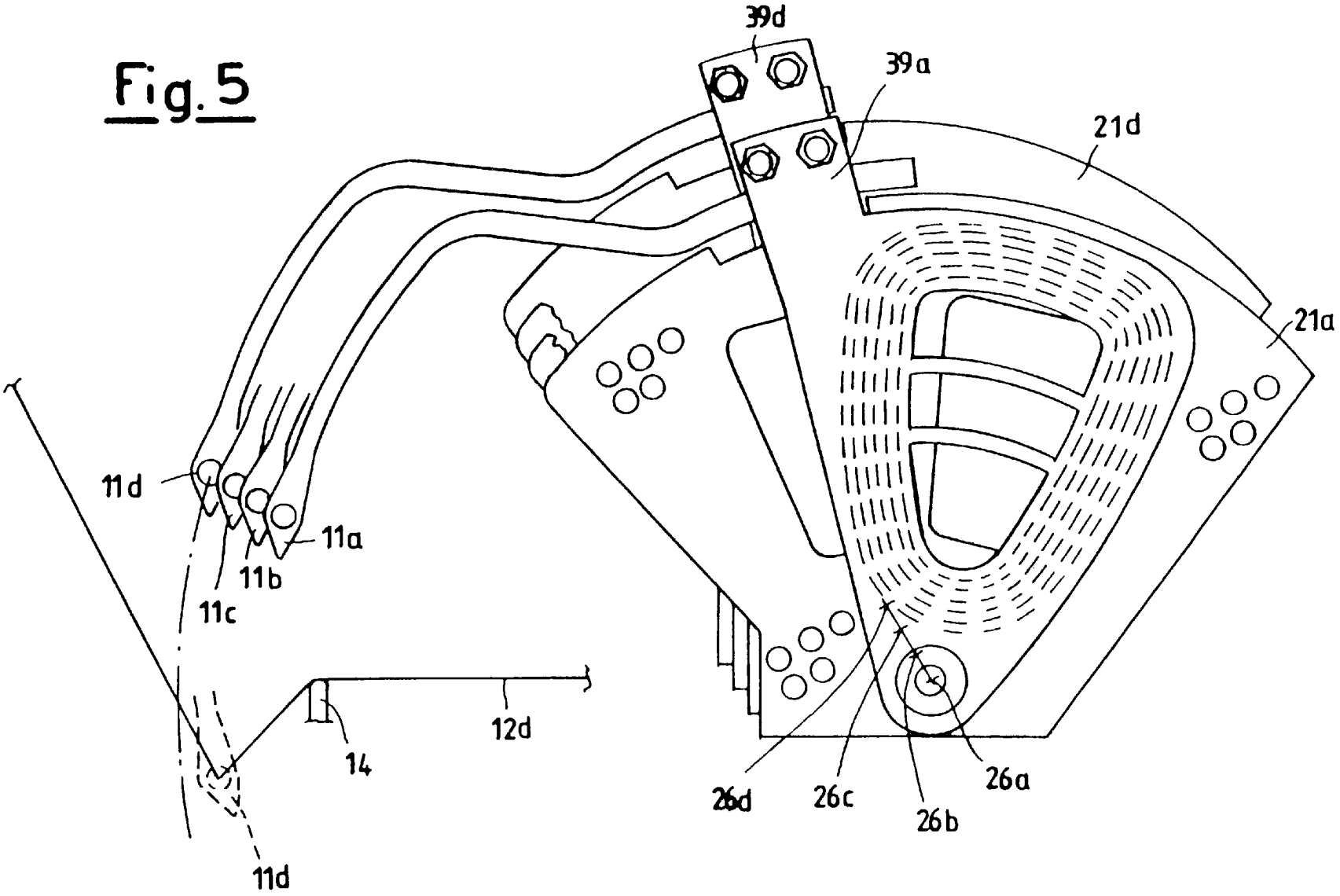
FIG. 5 is a schematic illustration showing the rods in a standby position with one rod in a presentation position.

FIG. 5 shows the overall assembly of the weft presentation device. To obtain the required distance between the weft yarns when in their rest position, in a preferred embodiment of the invention the various rods 11 are made all equal, but are mounted within their support 39 such that they project by progressively increasing lengths from 11*a* to 11*d*, by making the rod project to a greater or lesser extent from the element 39 according to its sequential position in the mounted presentation device, and always considering that they are shown as four in number for simplicity, but are in fact of a greater number.

The rod 11*d* is shown in its weft yarn delivery position. It can be seen that the fact of having offset its center of rotation to 26*d* makes the rod reach a position much closer to the bar 14 than it could have been according to the dashed and dotted line which represents the normal trajectory of the state of the art, ie with all the centers of rotation of the rods aligned parallel to the bar 14. The same is also true for the other rods, on the basis of their assembly with offsetting of the centers of rotation 26 in said skew direction.

Figure 6:
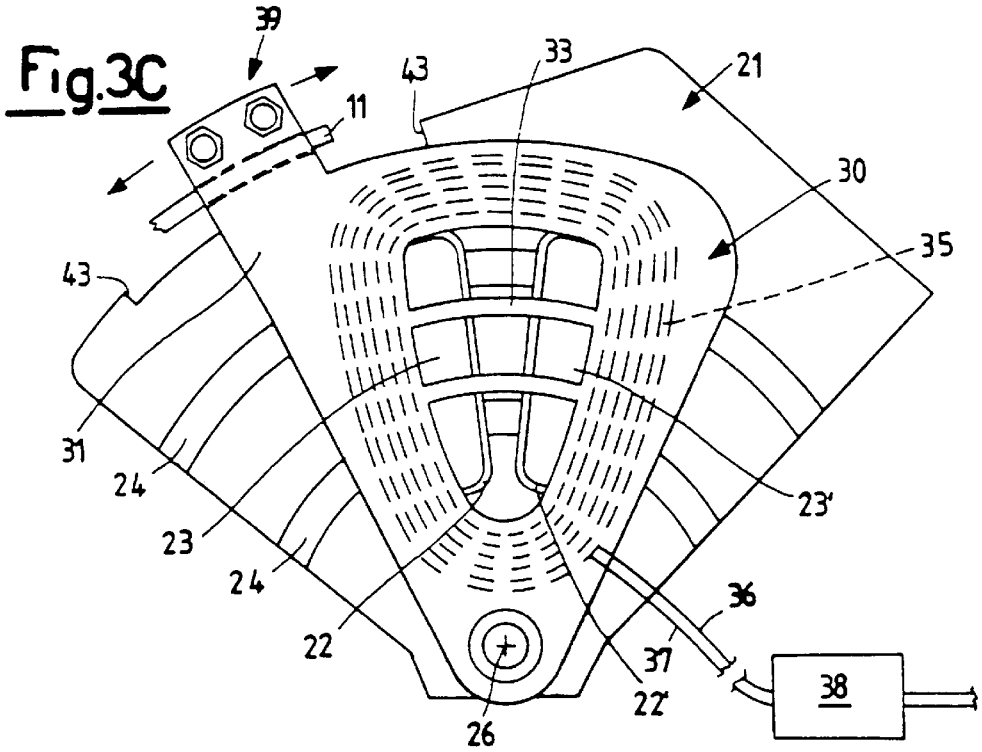
FIG. 6 is a schematic illustration of the shuttleless loom according to the present invention illustrating its advantages with respect to the prior art.
Figure 6:
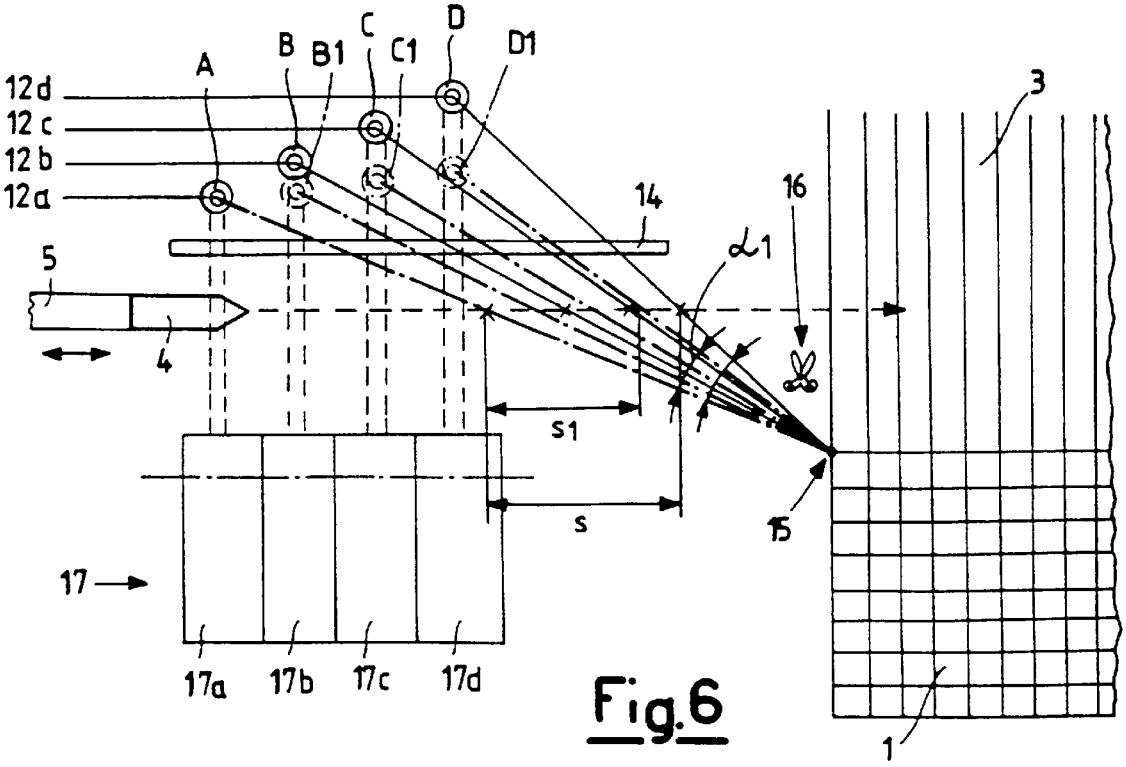

FIG. 6 shows the advantage achieved by displacing the points of delivery with the presentation device shown in FIG. 5. The points of delivery of the weft yarns by the various rods 11*a–d* pass from the points A–B–C–D, according to the state of the art shown in FIG. 2B and noting that the plate 21*a* has not undergone translational movement, to the points $A–B_1–C_1–D_1$.

Figure 1A:
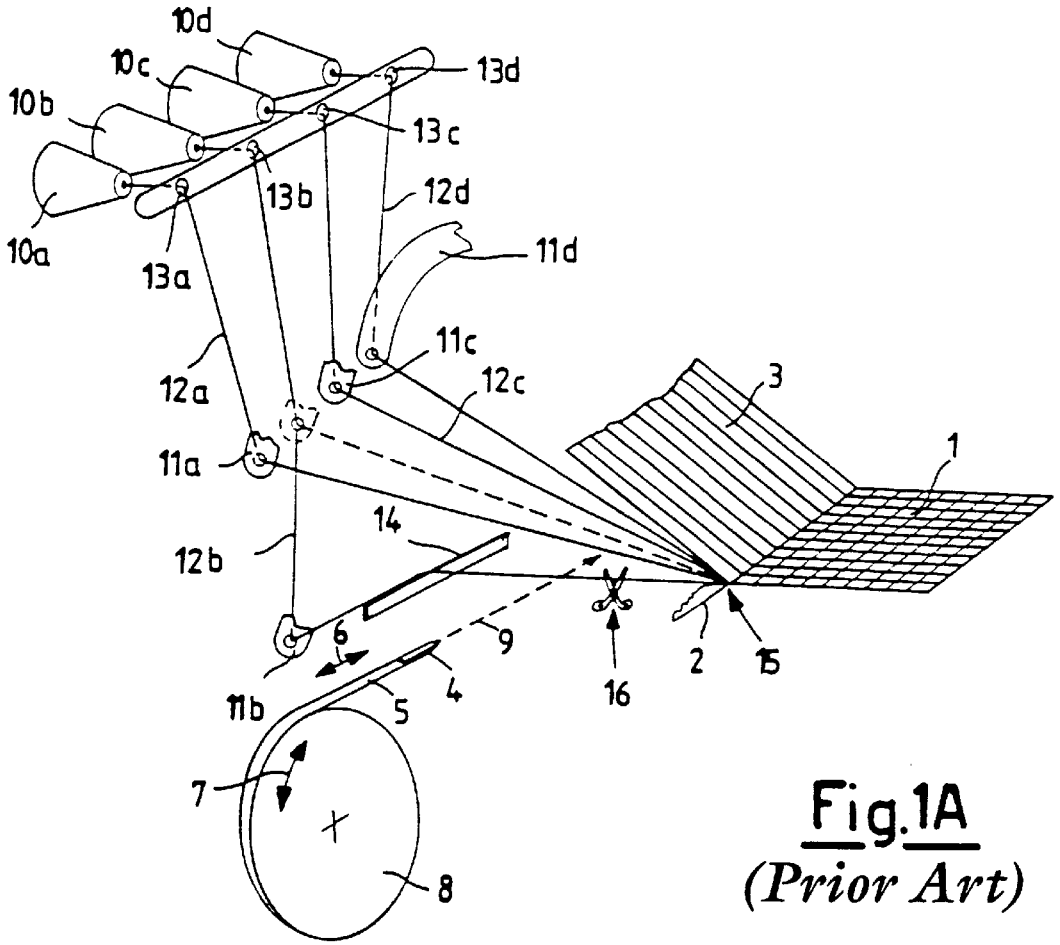
Fig.1A (Prior Art)
FIGS. 1A and 1B are schematic illustrations of prior art shuttleless looms.
Figure 1B:
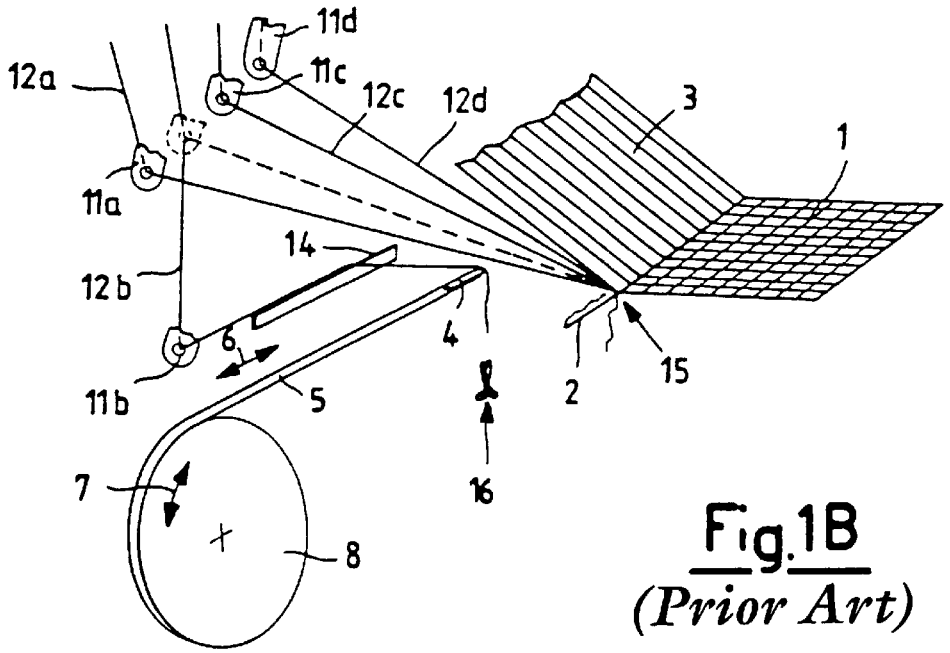
Fig.1B (Prior Art)
Figure 2A:
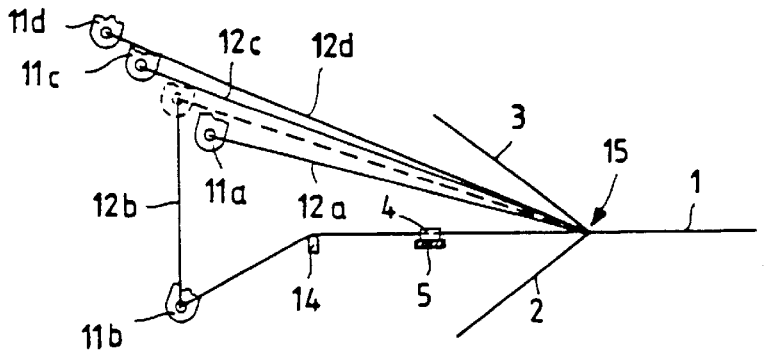
Fig. 2A (Prior Art)
FIGS. 2A and 2B are respective side elevation and plan views of the shuttleless loom illustrated in FIGS. 1A and 1B.
Figure 2B:
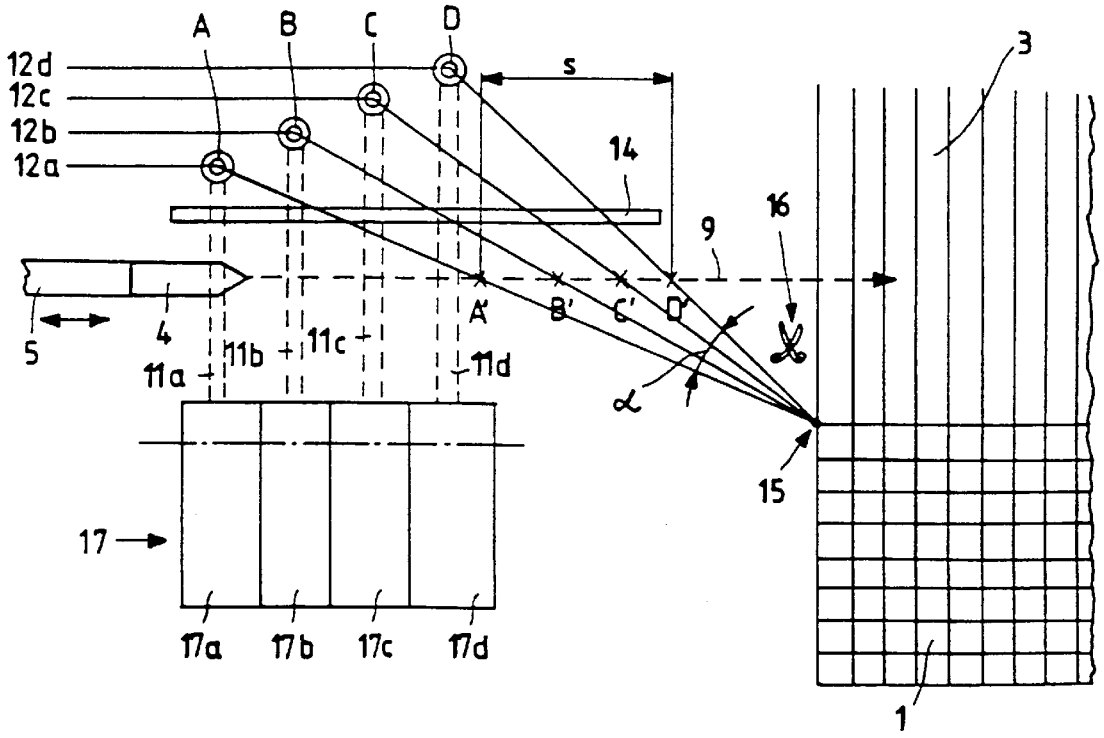
Fig. 2B (Prior Art)

Again starting from the same stand-by position, in which the various weft yarns are maintained duly spaced apart, the delivery segment s5 along which the weft yarns 12*a–d* are delivered is considerably shorter than the segment s of FIG. 2B. The angle $\alpha_1$, which in FIG. 6 comprises the bunch of straight lines joining the point 15 to the points $A–B_1–C_1D_1$, which represent the lowering into delivery of the weft yarn by the rods 11*a–d*, is substantially narrower than the angle a of the known art shown in FIG. 2B.

It should also be noted that this invention is able to provide both the effect of reducing the range of weft yarn presentation positions—starting from a certain staggering of the yarn stand-by positions—and also of greater spacing between the yarns at rest—for an equal range of positions of presentation of the weft yarn to the gripper.

Figure 7:
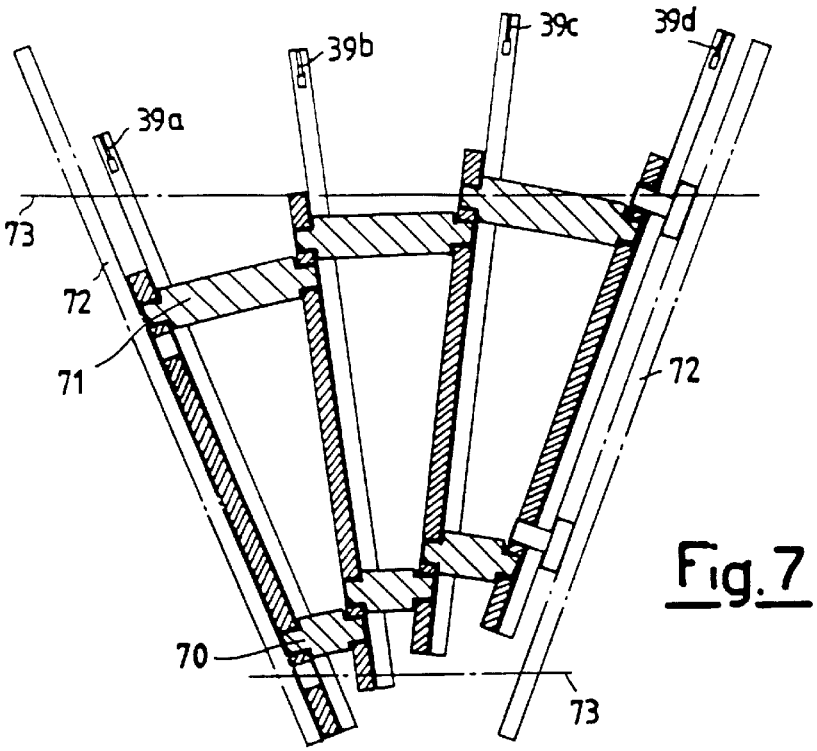
FIG. 7 is a cross-sectional illustration of the fixed plates and sliders in a divergent relationship in a further embodiment of the present invention.
Figure 8:
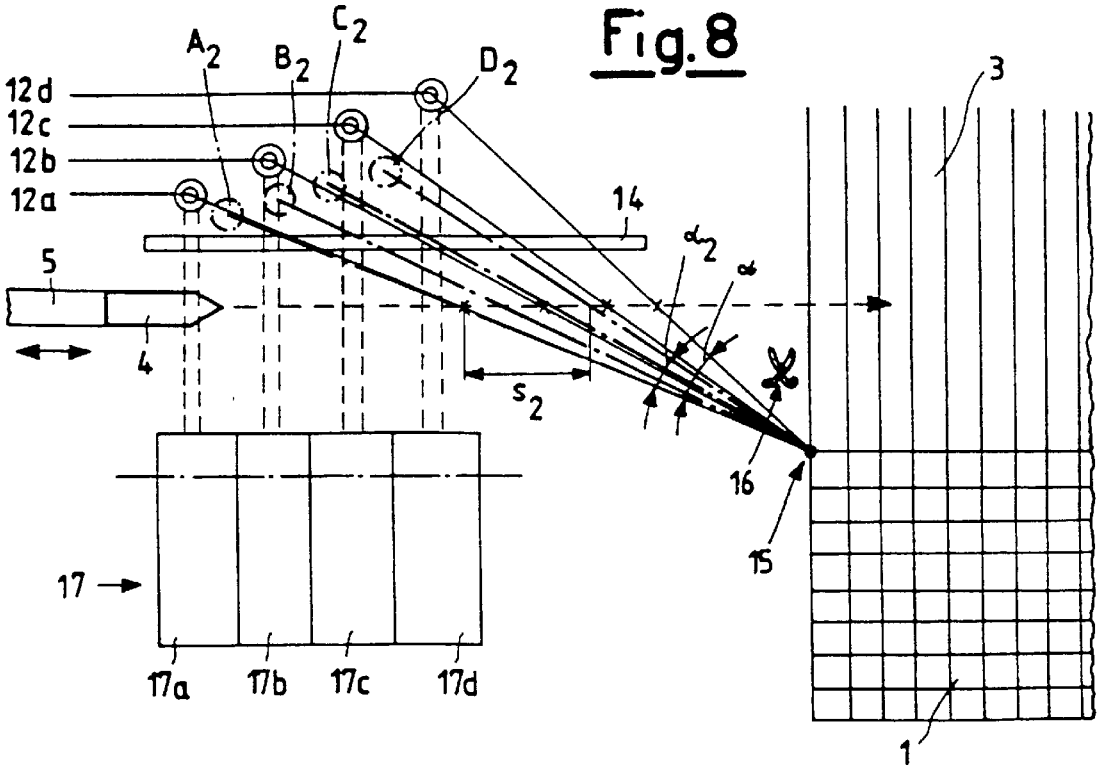
FIG. 8 is a view similar to FIG. 6 illustrating a further form of the invention.

The weft presentation devices shown in FIGS. 7 and 8 relate to a modified embodiment of the invention.

According to this modification, the linear motors formed by the plates 21 and sliders 30 are assembled no longer parallel to each other but such as to form a V one to the next, with the overall arrangement of the linear motors being in the form of a semi-open book, by using pins 70, 71 with their cylindrical intermediate part, of different lengths, serving as a spacer between the various frame plates 21, using shorter spacers for the part closer to the center of rotation 26 and longer spacers for those parts more distant from said center of rotation. The width of the angle between adjacent plates preferably lies within the range 0°–10°, with a total angle between the end plates within the range 0°–90°, considering the actual number of plates to be mounted.

The plates are hence mounted offset by being always displaced by one pitch in the direction of the chosen connection holes 50, 51, 52, but are no longer parallel. They are inclined to each other on the basis of the different lengths of the spacer elements of the pins 70, 71. FIG. 7 shows a view from the left side of the stack of plates 21, again shown as four in number for simplicity of drawing, but noting that they can be of a greater number.

The book-type plate assembly is then maintained in position by two terminal plates 72 and tie rods 73, analogously to that shown in FIG. 48 for the assembly of the linear motors with offset but parallel plates. Alternatively, this assembly can use C-brackets, not shown on the drawings for simplicity, to connect the end plates together.

With reference to FIG. 5, which shows the overall assembly of the weft presentation device, and considering the angular opening of the mounted plates one to the next as shown in FIG. 7, it can be seen that the rods 11 rotate into the yarn presentation position in planes which approach each other in proceeding downwards. The rod 11*d*, shown in FIG. 5 in its weft yarn delivery position, now reaches an even more favourable position in that, in addition to the approach to the bar 14 due to their mounting with offsetting of the centers of rotation 26 in the skew direction, there is an additional effect of mutual approach of the points of presentation $A_2$–$B_2$–$C_2$–$D_2$ of the weft yarn, as shown in FIG. 8.

The delivery segment $s_2$ for the weft yarns 12*a–d* is further shortened, and the angle $\alpha_2$, which comprises the bunch of straight lines joining the point 15 points $A_2$–$B_2$–$C_2$–$D_2$, which represent the lowering of the weft yarn on delivery by the rods 11*a–b*, is even more narrow.

According to a further embodiment of the invention, the frame plates 21 can be assembled with different projection distances of the rod, with different pitches, and with different angles, so as to provide one or more weft presenters with greater spacing when in the stand-by position, to accommodate possible weft yarns which are more likely to tangle with others, while still using identical components but mounting them differently.

Compared with weft yarn presentation devices of the known art, the device of the invention offers considerable advantages both in performance and in construction. In this respect, the device is constructed with rigid connections and, for yarn presentation, does not use flexible members interposed between the linear motor and the yarn guide rod. Such an interposing could result in a decrease in overall performance compared with the performance offered by the linear motor, such as velocity, acceleration, deceleration, time and angular position control.

With such an arrangement, during each presentation cycle the flexible member deforms to produce substantial friction within its guide sheath, compared with a yarn guide operated only as required. This circumstance is significant in the light of the performance required of the device. It must operate at a high presentation rate, with a frequency of 600–700 beats per minute, and with a precise trajectory in order not to involve adjacent yarns.

We claim:

1. Weft yarn presentation apparatus in a shuttleless loom for forming a fabric, comprising a plurality of presentation devices, one for each weft yarn, each said presentation device including a linear electric motor comprised of a fixed plate carrying permanent magnets, a rotary slider, and a rod rigidly connected to said slider and rotatable with said slider to present a weft yarn carried by an end thereof to a movable gripper, said sliders being pivotally mounted to said fixed plates, respectively, for rotation about respective axes, said rod ends being maintained separated from one another in raised positions thereof to maintain the weft yarns carried thereby separated from one another, said rod ends being movable into lowered delivery positions for presenting the weft yarns to the gripper, said lowered positions of said rod ends being spaced closer to one another than said raised positions, said presentation devices being joined together to form an assembly thereof with the axis of rotation of each slider of each presentation device being offset from one another and arranged on a line skewed relative to a path of movement of said gripper, the fixed plates, in the direction of the fabric, being successively arranged in progressively raised positions, and successive axes of rotation of said sliders being successively arranged in the direction of the plane of the respectively fixed plates with an offset angle between 0°–90° relative to the horizontal.

2. Apparatus according to claim 1 wherein each said projecting element has an adjustable mount for the weft yarn presentation rod for projecting said rod to a greater or lesser extent from said element according to the sequential mounting position of said rod within the presentation devices.

3. Apparatus according to claim 1 including through holes in said plates for assembling the plates and pins having opposite ends for engaging in said holes and having enlarged intermediate parts serving as spacers between said plates.

4. Apparatus according to claim 3 wherein said plates in said assembly thereof lie parallel to and offset from one another, the intermediate parts of said spacers having equal lengths at least for each of the mutual facing pairs of plates.

5. Apparatus according to claim 1 wherein said plates lie in respective planes angularly divergent from one another from adjacent said pivotal mounting between said sliders and said plates, said plates forming acute angles therebetween.

6. Apparatus according to claim 5 wherein the angle between adjacent plates in said assembly thereof lies within a range of 0°–10° and the total angle between end plates of said assembly thereof lies within a range of 0°–90°.

7. Apparatus according to claim 1 including through holes in said plates for assembling the plates to one another, and pins having intermediate spacer parts of different lengths for engaging in said holes with shorter spacer parts between said holes adjacent said pivotal mounting and longer spacer parts between said holes further from said pivotal mounting.

* * * * *